US005590613A

United States Patent [19]

Head

[11] Patent Number: 5,590,613

[45] Date of Patent: Jan. 7, 1997

[54] APPARATUS FOR FRAMING FABRIC IN EMBROIDERY HOOPS

[76] Inventor: Allan J. Head, 22 Webb Street, Wellington, New Zealand

[21] Appl. No.: 454,134

[22] PCT Filed: Jun. 1, 1993

[86] PCT No.: PCT/NZ93/00045

§ 371 Date: Jun. 8, 1995

§ 102(e) Date: Jun. 8, 1995

[87] PCT Pub. No.: WO94/13874

PCT Pub. Date: Jun. 23, 1994

[30] Foreign Application Priority Data

Dec. 8, 1992 [NZ] New Zealand ..... 245396

[51] Int. Cl.[6] ..... D05C 9/04; D06C 3/08

[52] U.S. Cl. ..... 112/103; 38/102.2

[58] Field of Search ..... 112/103, 470.14, 112/78, 236; 38/102.2

[56] References Cited

U.S. PATENT DOCUMENTS

| | | | |
|---|---|---|---|
| 3,664,288 | 5/1972 | Weidlin Von Boden | 112/103 |
| 4,545,127 | 10/1985 | Barry | 33/180 R |
| 4,561,177 | 12/1985 | Rancer | 38/102.2 X |
| 4,644,629 | 2/1987 | Moore, III | 38/102.2 X |
| 4,767,111 | 8/1988 | Guenther | 269/303 |
| 4,774,778 | 10/1988 | Williams | 38/102.2 |
| 4,837,913 | 6/1989 | Moore, III | 38/102.2 X |
| 5,144,899 | 9/1992 | Allen | 112/103 |
| 5,433,158 | 7/1995 | Moore, III | 112/103 |

FOREIGN PATENT DOCUMENTS

| | | |
|---|---|---|
| 2293460 | 12/1990 | Japan . |
| 4244161 | 9/1992 | Japan . |

*Primary Examiner*—Ismael Izaguirre
*Attorney, Agent, or Firm*—Brooks & Kushman P.C.

[57] ABSTRACT

Apparatus for framing a portion of a fabric workpiece in an embroidery hoop, the apparatus including a mount for a hoop holder, such that when mounted on the apparatus the hoop holder holds and locates a female portion of an embroidery hoop, a workpiece holder, to spread or hold a fabric workpiece over the hoop holder, and a support assembly to orient and locate the hoop holder and a workpiece holder in position in a substantially common plane when the embroidery hoop is to be mounted on the workpiece, characterized in that the apparatus further includes an adjustment device enabling adjustment of the relative positions of the workpiece holder and the hoop holder within a substantially common plane.

19 Claims, 4 Drawing Sheets

FIG.4
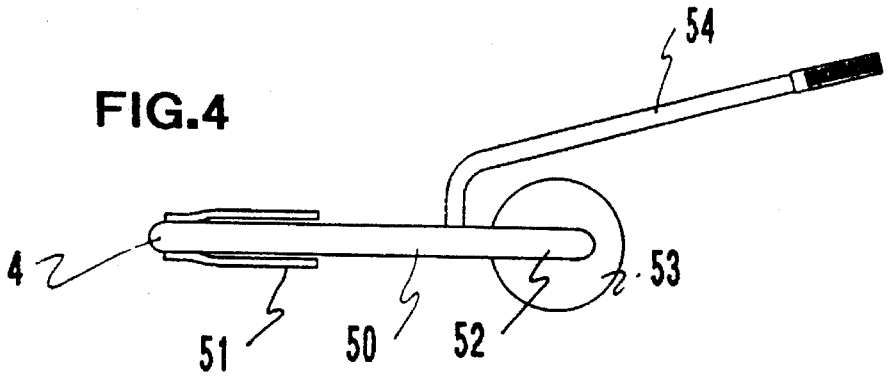
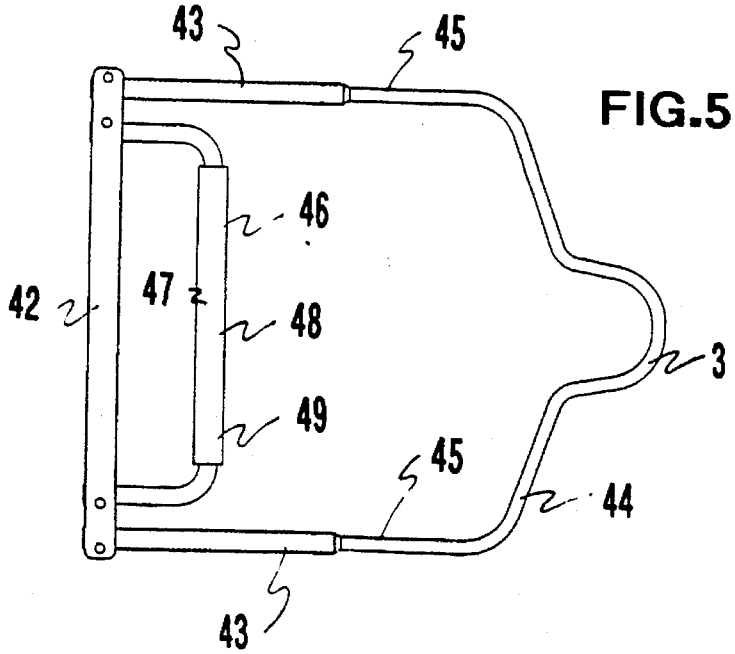
FIG.5
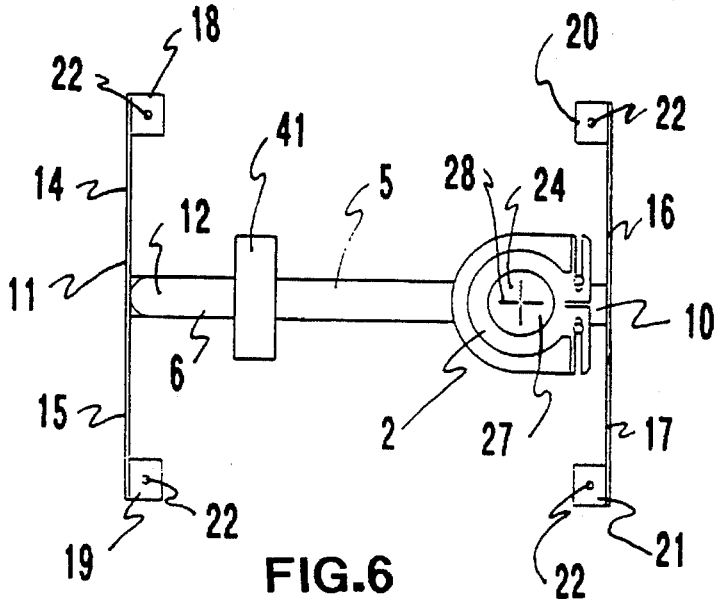
FIG.6

APPARATUS FOR FRAMING FABRIC IN EMBROIDERY HOOPS

TECHNICAL FIELD

This invention relates to apparatus for frying fabric in embroidery hoops and, more particularly, to apparatus for assisting in positioning a keyed embroidery hoop on a fabric workpiece then subsequently mounting the hoop on the workpiece at the desired position.

BACKGROUND ART

Almost all commercial embroidery operations now use multi-head automatic embroidery machines. Such machines have the potential to greatly increase operator productivity. However, difficulties remain in supplying hooped workpieces at a rate sufficient to allow the embroidery machines to be operated continuously and, therefore, at maximum efficiency. This problem is largely caused by the fact that the hooping of workpieces has, until now, been a slow, relatively painstaking and almost entirely manual operation.

The difficulties with the manual hooping operation may broadly be considered as two-fold; firstly in correctly positioning and orientating the hoop relative to the workpiece and, secondly, in mounting the workpiece between the male and female portions of the keyed embroidery hoop.

The problems with correct positioning and orientation of a hoop relative to a workpiece are fully detailed in U.S. Pat. No. 4,454,127, which also discloses, in an attempt to overcome these problems, a positioning system for locating a keyed embroidery hoop on a workpiece, including a hoop mounting plate; a hoop recess in the mounting plate for receiving a keyed hoop; a centre line on the plate; and a plurality of parallel gauge lines for positioning a workpiece on the plate relative to the hoop recess.

The system of the above noted U.S. Pat. No. is not fully successful in overcoming the problems discussed on a number of counts. For example, the position of the hoop recess 14 (hoop holder) relative to the hoop mounting plate 12 (workpiece holder) is largely fixed, or at least movement is disclosed as being only possible in one direction and even then only in the discreet steps using a spacer 90. Moreover, while registration members 26, 30 and 28, together with recess 20, assist in ensuring correct orientation of a workpiece relative to the hoop 16 truely accurate positioning and orientation is not possible because with, for example, a sweat shirt or the like on the system 10 none of the aligning mechanisms are visible to enable final and fine adjustment.

In locking of the workpiece between the male and female portions of the keyed embroidery hoop the principle problem is that it can be quite a physical task, and while it is possible to use the ball of each hand to force the two portions together, more often than not the operation is effected using the tips of the fingers. This places considerable stresses on the fingers and, especially if many workpieces are hooped in a continuous fashion, repetitive strain injuries can occur. Other problems can arise in the form of the positioned workpieces slipping or gathering as the two hoop portions are pressed together.

It is an object of the present invention to provide apparatus that at least partially overcomes one or more of the above noted problems or difficulties.

SUMMARY OF THE INVENTION

In a broad aspect of the invention there is provided an apparatus for framing a portion of a fabric workpiece in an embroidery hoop, the apparatus comprising a hoop holder, to hold and locate a female portion of an embroidery hoop, a workpiece holder, to spread or hold a fabric workpiece over the hoop holder, a support assembly to orient and locate the hoop holder and workpiece in position in a substantially common place when a said embroidery hoop is to be mounted on a said workpiece, characterised in that the apparatus further includes adjustment means enabling adjustment of the relative positions of the workpiece holder and the hoop holder within the substantially common plane.

The present invention provides a significant advantage over the prior art, in that virtually any portion of the fabric workpiece spread out or held by the workpiece holder can be quickly and easily positioned over the hoop holder.

Preferably, the hoop holder is fixed in position, and the adjustment means enables adjustment of the position of the workpiece holder in substantially the same plane as, and relative to, the hoop holder.

Desirably, the position of the workpiece holder can be adjusted with a said workpiece spread out or held thereon.

The adjustment means can comprise a pair of perpendicularly operable slide arrangements. Expediently the adjustment means comprises a first slide arrangement enabling crosswise adjustment, and a second slide arrangement enabling forward and backward adjustment.

In a preferred form the workpiece holder comprises a tubular frame shaped approximately to the workpiece. With the workpiece holder in this form the second slide arrangement can consist of parallel telescoping sections on each side of the tubular frame.

The workpiece holder may be shaped to a specific type or kind of workpiece, such as, for example, a T-shirt, trousers etc. To enable different kinds of workpieces to be hooped the workpiece holder is preferably removable.

Additionally, or alternatively, the workpiece holder may be adjustable in size and shaped to assist in making certain that the workpiece is spread or flat as possible over the portion targetted for hooping. In this connection the workpiece holder may include spring loaded spreading members.

A further inventive feature of the present invention is that the hoop holder can include a pair of gauge lines crossing to indicate the centre of the female portion of the embroidery hoop when in position, the gauge lines being illuminated from beneath the hoop holder so as to be substantially visible through a said workpiece when the said workpiece is positioned on the hoop holder.

The apparatus of the present invention may further include a hoop press to mount a said workpiece between the male and female portions of the embroidery hoop, the hoop press comrising a support frame on which is mounted a compressing means movable between a first, retracted position and a second position where the male portion of the embroidery hoop can be moved into frictional engagement with the female portion with the workpiece mounted therebetween, and an activating means for urging the compressing means between the first and second positions.

Optionally the hoop press can include a limiting means to limit to a predetermined maximum level the urging force the activating means can generate on urging the compressing means between the first and second positions.

Preferably, the activating means comprises a hand or foot operable lever.

Desirably, the first, retracted position of the compressing means is fixed with respect to the position of the hoop holder.

The provision of a limiting means to limit the maximum force that can be applied to the male portion of the keyed embroidery hoop when urging it into frictional engagement with the female portion can be of significant advantage, particularly when the activating means is foot operable, comprises a hydraulic or pneumatic arrangement, or includes a force amplifying linkage, primarily because it ensures that the workpiece mounted therebetween is not damaged; if the relative sizes of the hoop portions have not been correctly adjusted it would be possible, when urging the portions into engagement, to cut through the workpiece, thereby rendering it useless.

As a related matter, the apparatus of the present invention may furthermore include a novel hoop holder.

In this regard, the female portion of a typical embroidery hoop is adjustable in terms of diameter, so that the difference between the outer diameter of the male portion and the inner diameter of the female portion can be set for a particular fabric thickness. If the diameter of the female portion of the hoop is too large the fabric of the workpiece will not be firmly held, so that the pattern to be embroidered may be distorted, and the male portion of the hoop may even come out. If the diameter of the female portion is too small the fabric of the workpiece may be cut or otherwise damaged when the male portion is inserted.

Unlike prior art hoop holders, which simply incorporate one or more oversized cut outs to accommodate the key, or adjustment mechanism of the embroidery hoop, the improved hoop holder of the present invention includes a greatly oversized cut out, together with a pair of adjustably positionable lugs between which the key of the hoop is intended to be snuggly received.

An advantage of the improved hoop holder, is that the location of the lugs can firstly be set to the spacing required for the key of the female portion of a hoop correctly adjusted to a specific fabric thickness. Subsequent female hoop portions can then be quickly, accurately and easily assessed for setting accuracy because female hoop portions with undersized diameters will have keys which are a loose fit between the lugs, and female hoop portions which oversized diameters will have keys which do not fit at all between the lugs.

BRIEF DESCRIPTION OF THE DRAWINGS

A presently preferred embodiment of the invention will now be described, by way of example only, with reference to the accompanying drawings, in which:

FIG. 4 illustrates a plan view of the hoop press of the apparatus of FIG. 1;

FIG. 5 illustrates a plan view of the workpiece holder of the apparatus of FIG. 1;

FIG. 6 illustrates a plan view of the hoop holder and support assembly of the apparatus of FIG. 1;

Figure 2:
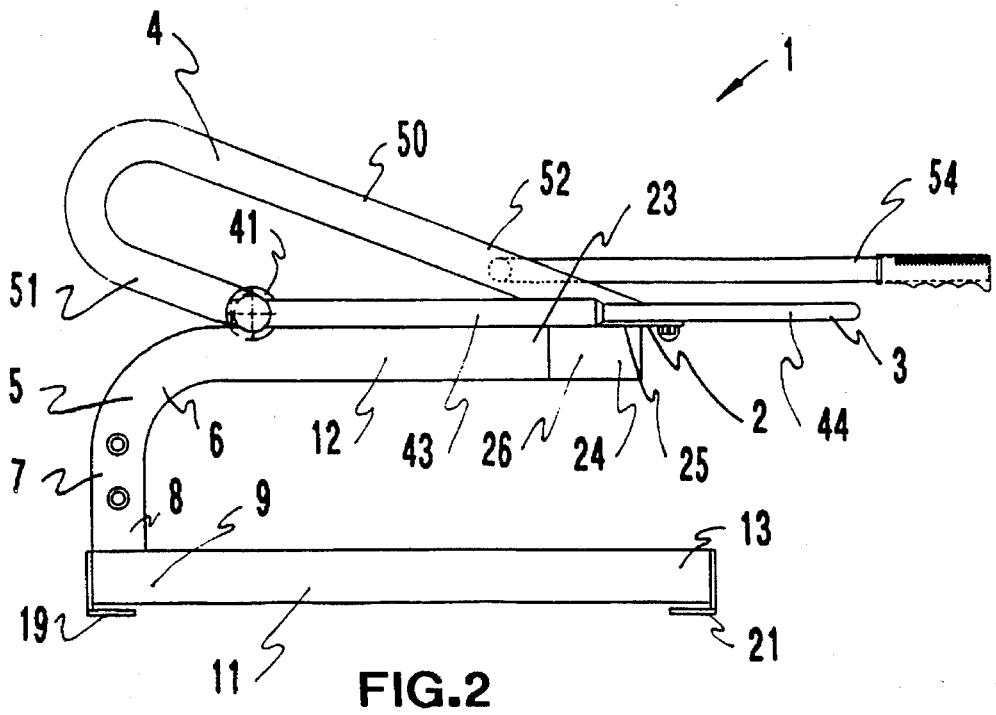
FIG. 2 illustrates a further side elevation of the apparatus of FIG. 1, with the hoop press in the pressing position.
Figure 1:
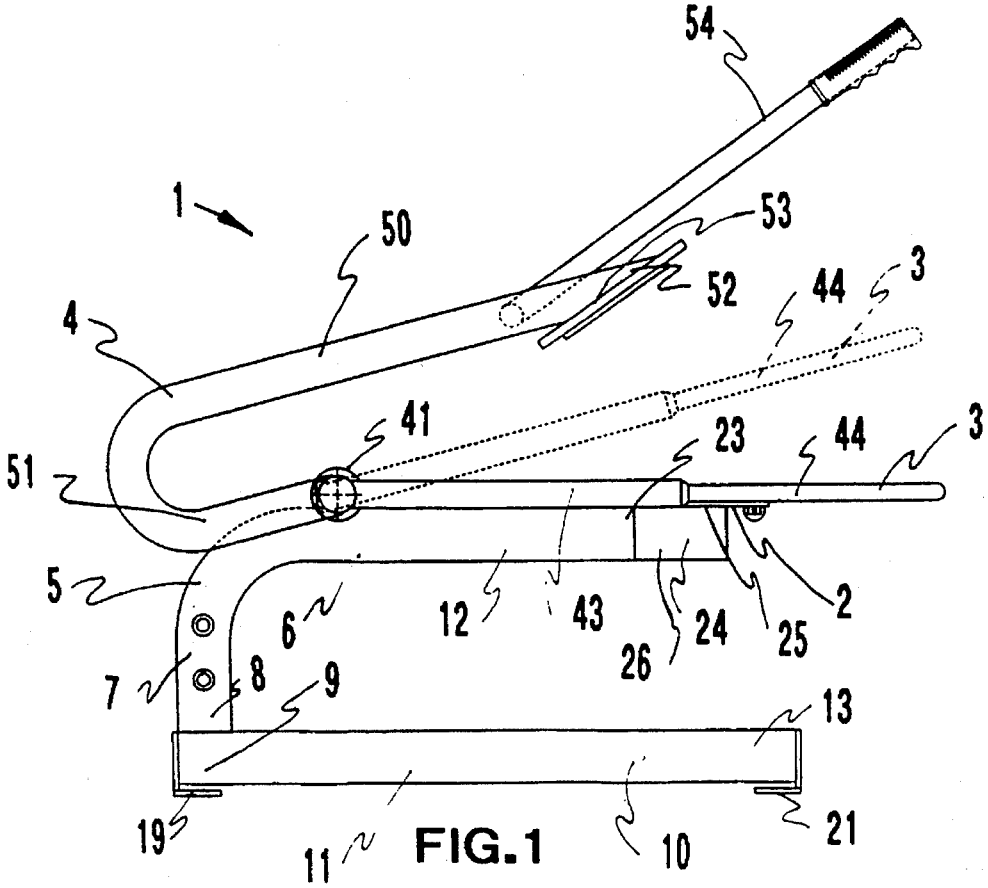
FIG. 1 illustrates a side elevation of an apparatus according to the present invention, showing the hoop press in the retracted position and the workpiece holder in two different positions.

As illustrated in the drawings, FIGS. 1 to 3C, the preferred embodiment of the present invention comprises an apparatus, as generally indicated at 1, having a hoop holder 2, a workpiece holder 3, a hoop press 4 and a support frame 5.

Referring now also to FIG. 6, the support frame 5 comprises a main support member 6, which is substantially L-shaped in side elevation. The short leg 7 of the member 6 depends substantially vertically, with the free end 8 being attached to an end 9 of a horizontally extending central element 10 of a base 11. The element 10 lies substantially parallel to the long leg 12 of the main support member 6. To complete the main structure of the base 11 there are provided legs 14–17, one said leg 14, 15, 16, 17 jutting perpendicularly outwardly from each side of the end 9 and other end 13 of the central element 10. Further, each leg 14, 15, 16, 17, terminates in a foot, 18, 19, 20 and 21 respectively. The feet 18–21 are adapted to mount the apparatus 1 on any convenient, substantially planar support surface (not shown). In this regard, the apparatus 1 may be free standing or, if the situation requires, may be attached to the support surface by way of bolts, screws or the like mounted through one or more apertures 22 provided in each foot 18–21.

The free end 23 of the long leg 12 of the main support member 6 of the support frame 5 terminates in a light box 24 and a hoop holder mounting 25.

The-light box 24 comprises an enclosed cheer 26 having a substantially planar upper wall 27, centrally located in and through which is an aperture 28 which is in the shape of a cross. A light source (not shown) is housed within the chamber 26 which, when turned on, emitts a bright light out through the aperture 28. The hoop holder mounting 25 is provided on top of the upper wall 27 of the light box 24, and may comprise a plurality of screw threaded apertures (not shown) extending into the wall 27 into which screws or the like may be applied to hold and locate the hoop holder 2.

Turning now to FIGS. 3A to 3C, 6 and 7 to 9, the hoop holder 2 comprises a plate 29, of thickness 30, having a centrally positioned aperture 31 therethrough, which aperture 30 is configured and arranged to frame the aperture 28 of the light box 24. Surrounding the aperture 31 there is provided a circular recess 32 dimensioned to receive a particular size of adjustable diameter female hoop portion (see FIG. 7).

Figure 7:
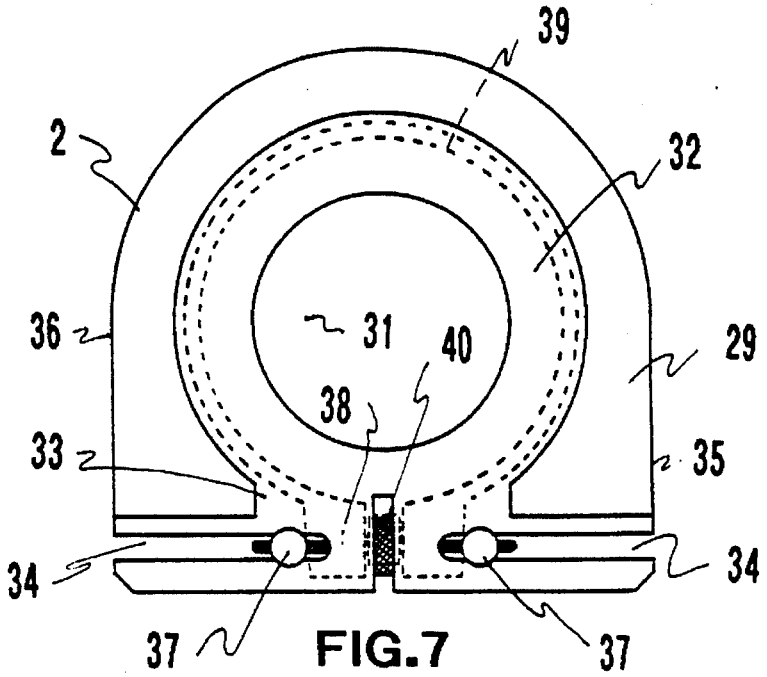
FIG. 7 illustrates a plan view of the hoop holder of the apparatus of FIG. 1.
Figure 9:
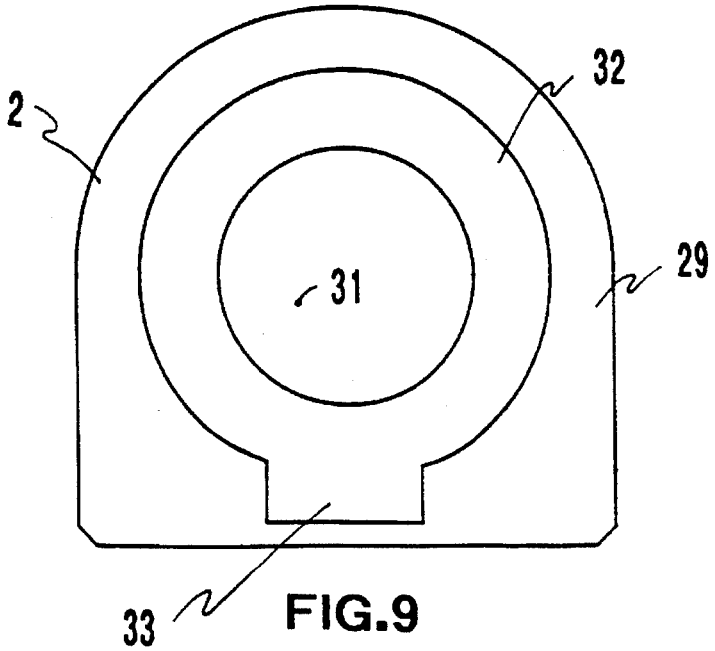

Referring now specifically to FIG. 9, in its simplest form the hoop holder 2 need only additionally comprise a further recess 33 off to one side of the recess 32 for receiving the key or diameter adjustment mechanism of the female hoop portion (shown at 38, 39 respectively, in FIG. 7). Extra recesses corresponding to recess 33 can be provided at, for example, 90 degree intervals around the recess 32 for different embroidery orientations.

Figure 8:
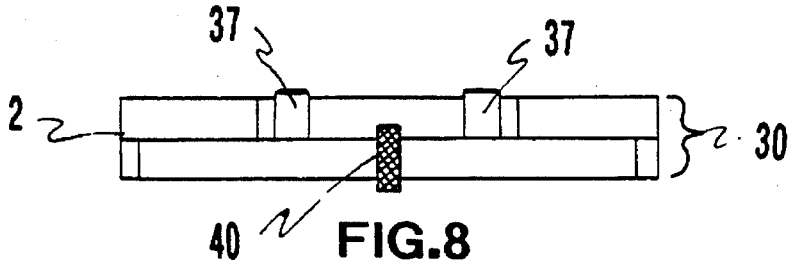
FIG. 8 illustrates an end elevation of the hoop holder of the apparatus of FIG. 1; and, FIG. 9 illustrates a plan view of an alternative hoop holder suitable for use with the apparatus of FIG. 1.

FIGS. 7 and 8 illustrate a more complex hoop holder 2 in which the recess 33 is enlarged, taking up a greater portion of the recess 32 and extending outwardly to the edge of the plate 29. A pair of aligned slots 34 oriented tangentially to the edge of the recess 32 extend inwardly from opposite edges 35, 36 of the plate 29 for an equal distance, but terminate short of each other. Upstanding from each slot 34 is a slidably mounted locating lug 37, the key, or diameter adjustment mechanism 38 of a female hoop portion 39 being locatable between the pair of said lugs 27.

Sliding adjustment of the lugs 37 is preferably achieved by way of an adjustment wheel 40 mounted within a slot 41 in the plate 29, a screw threaded shaft extended perpendicularly out from each side of the wheel 40, the screw threading on the shafts (not shown) being of opposite hands. Each lug 37 includes a screw threaded aperture adjacent its base into which one of the screw threaded shafts extends. Rotation of the wheel 40 in one direction draws the lugs 37 together, whereas rotation in the opposite direction pushes them apart. Hence the spacing between the lugs 37 can be adjusted to suit a particular setting of the key 38 of the female hoop portion 39, and indeed, may be used to confirm that the key 28 of subsequent female hoop portions 39 are correctly set.

Mounted on, and horizontally and perpendicularly to, the long leg 12 of the main support member 6 of the support frame 5 is a short tubular element 41. More particularly, the element 41 is located on the long leg 12 adjacent the bend transition into the short leg 7 of the main support member 6. Both the workpiece holder 3 and hoop press 4 are hingedly mounted to the support frame 5 by way of the element 41.

As shown in FIGS. 1 to 3C and 5, the workpiece holder 3 comprises an elongate tubular bar 42, perpendicularly outwardly from each end of which extends a further tubular bar 43, said bars 43 being parallel and of substantially the same dimensions.

A tubular frame 44 bent into the approximate shape of a particular variety of workpiece is slidably engagable With the free end of each bar 43. In this connection, the frame 44 incorporates a pair of parallel tubular arms 45 spaced apart to the same spacing as the bars 43, and dimensioned to slidably engage with the free ends of the said bars 43.

The workpiece holder 3 further includes a stop 46 mounted on the bar 42 comprising a U-shaped member 47 having an elongate central portion 48 which is parallel to the bar 42.

Figure 3A:
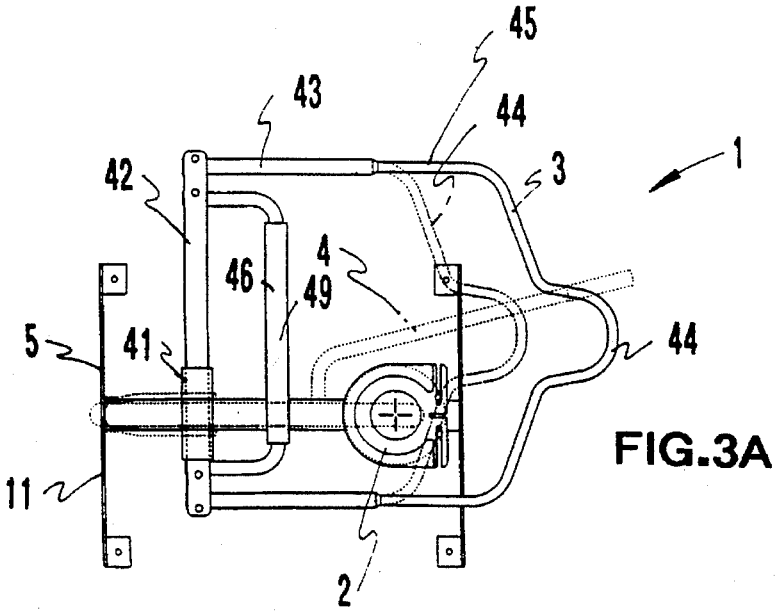
FIGS. 3A to 3C illustrates plan views of the apparatus of FIG. 1, each with the workpiece holder in two different positions.
Figure 3B:
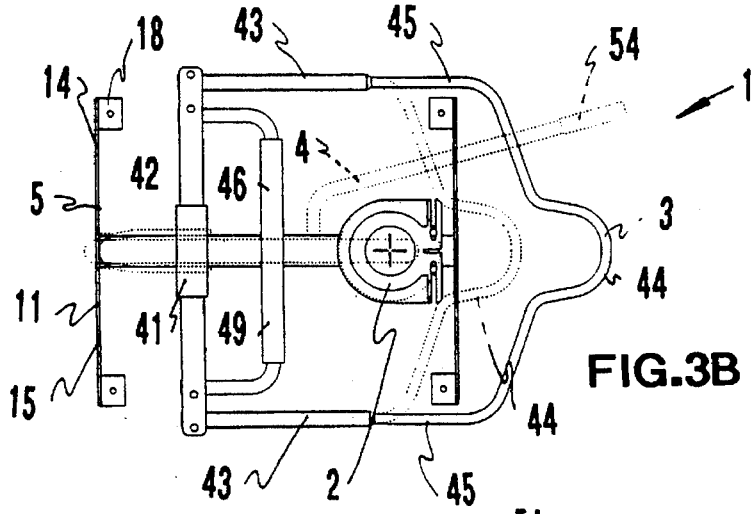
Figure 3C:
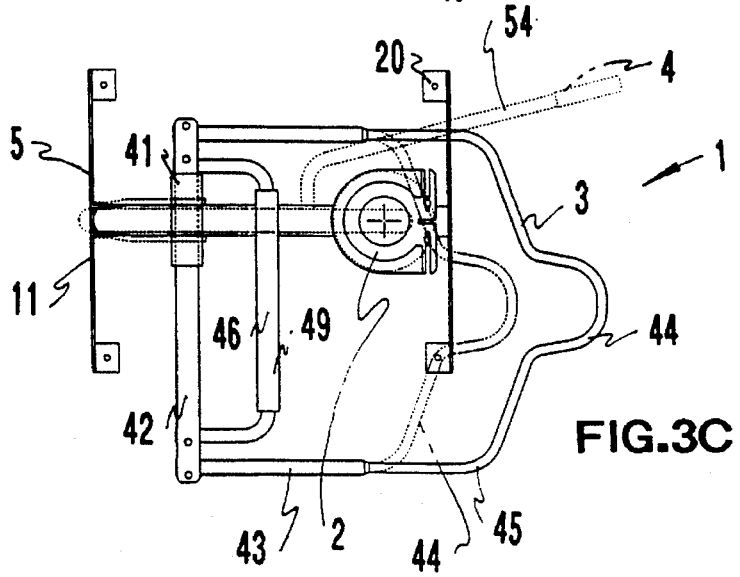

Adjustment of the position of the workpiece holder relative to the hoop holder 2 is achievable in the cross-wise direction because the elongate bar 42, while hingedly located in the tubular element 41 of the support frame 5, can slide cross-wise (see FIGS. 3A to 3C). The stop 46 acts to prevent cross-wise sliding of the bar 42 when the workpiece holder 3 is substantially co-planar with the hoop holder 2 by resting on the long leg 12 of the main support member 6 of the support frame 5, and in this regard the central portion 48 of the stop 46 is preferably sheathed in rubber or the like to provide a slip resistant coating 49. When cross-wise adjustment of the workpiece holder 3 is required the workpiece holder 3 is pivoted up out of the common plan with the hoop holder 2, thereby lifting the stop 46 clear of the long leg 12 of the support frame 5 and allowing the bar 42 to slide through the tubular element 41 as necessary.

Backward and forward adjustment of the position of the workpiece holder 3 relative to the hoop holder 2 is achieved by virtue of the ability of the arms 45 of the frame 44 to telescope into the bars 43, (see in particular FIGS. 3A to 3C).

As noted above, and as shown in the drawings, FIGS. 1 to 4, the hoop press 4 is hingedly mounted to the support frame 5 by way of the element 41. The hoop press 4 comprises an elongate bar 50, one end of which is bent back on itself to terminate in a free end 51 hingedly mounted at the element 41. At the other end 52 of the bar 50 there is provided a fitting 53 on which the male portion of a hoop (not shown) can be mounted, the mounting being a very slight interference fit between the male hoop portion and the fitting 53, enough to retain the male hoop portion on the fitting 53 until pressed into engagement with the corresponding female hoop portion.

The hoop press 4 further comprises an actuating arm 54 having an end attached to the bar 50 adjacent the fitting 53. The actuating arm 54 is intended for hand operation, and acts to pivot the bar 50 about the hinge connection with the support frame 5. In so doing the fitting 53 is moved between the retracted position, as illustrated in FIG. 3, and the compressing position, as illustrated in FIG. 2.

Prior to use the apparatus 1 must be correctly set up for the type of workpiece and size of embroidery hoop.

In this connection, the appropriate shape of frame 44 for the type of workpiece must first be selected and installed on the workpiece holder 3. Next the appropriate size of embroidery hoop must be identified so that the correct hoop holder 2 can be mounted on the hoop holder mounting 25. Then, assuming the hoop holder 2 is of the kind illustrated in FIGS. 7 and 8, the location of the lugs 37 must be adjusted to accommodate the key 38 of a correctly sized female hoop portion 39. Finally, the workpiece holder 3 should be moved to the approximate position where the embroidery hoop is to be mounted on the workpiece.

In use a female hoop portion is placed in the hoop holder 2, next a workpiece is spread over the workpiece holder 3. Then a male hoop portion is mounted on the fitting 53 of the hoop press 4. As the actuating arm 54 is pulled away from the position it rests in when the hoop press 4 is retracted the light source in the light box 24 is switched on, preferably automatically by way of a proximity switch or the like. The workpiece itself is usually marked with the centre of the design to be embroidered. Accordinlgy, at this point it can be confirmed whether or not the workpiece is correctly positioned relative to the hoop holder because of the indication given by the light shining through the cross aperture 28. Final adjustments of the workpiece holder 3 position may then be made by pivoting the workpiece holder 3 out of the same plane as the hoop holder 2 and sliding the workpiece holder 3 crosswise, or by pulling or pushing the frame 44 forward or back, respectively, as regards the telescoping of the bars 43 and arms 45 of the workpiece holder 3.

Once final adjustments have been made the hoop press 4 can be fully operated and the male hoop portion pressed together with the female portion. The hooped workpiece can then be removed and the process repeated.

In some instances it will be inappropriate to use the workpiece holder 3, such as for example with hats or caps. In that case the frame 44 can be removed from the workpiece holder 3 and the remaining parts of the workpiece holder 3 pivoted up and back out of the way. The apparatus 1 can then be used with just the hoop press 4 and hoop holder 2.

In further instances it may be easier to simply dispense with the hoop press 4, in which case it may be removed and the apparatus 1 either used with the hoop holder 2 and workpiece holder 3, or with the hoop holder 2 alone.

Additional advantages of the present invention will become apparent to those skilled in the art, after considering the general principles disclosed, as well as the particular form discussed and illustrated.

Accordingly, it will be appreciated that changes may be made to the above described embodiment of the invention without departing from the principles taught herein.

In particular, although the preferred embodiment discloses that the hoop holder is stationary and the workpiece holder is movable it is to be understood that the invention specifically contemplates that the workpiece holder can be fixed in position, with the hoop holder being movable to any position beneath the workpiece.

In this regard the hoop holder could be mounted on a pair of perpendicularly arranged and operable slidable assemblies.

Moreover, either the hoop holder or workpiece holder could be mounted on a pivot arm combination hanging off the support frame to enable relative movement to any position in the common plane within the confines of the workpiece. The only major design constrains of relevance being to ensure that the workpiece, if tubular such as a tee shirt, trousers or the like can pass both under and over the hoop holder to allow access to all parts thereof.

Furthermore, and as has been alluded to above, the frame 44, or indeed the workpiece holder itself may be varied in shape to accommodate different sorts of workpieces and may include various accessories, such as clips and the like to hold workpieces such as shirt panels etc which are not tubular and therefore able to be maintained in a spread out form using the frame 44 disclosed in the preferred embodiment.

Still further, in the preferred embodiment the hoop press 4 is only able to move in one plane. It will immediately be apparent however that embodiments in which the hoop press can be moved in one or more additional planes may be advantageous under some conditions, and indeed would be essential were the hoop holder the moving component (unless the hoop holder and hoop press were otherwise linked).

Finally, turning to the hoop holder, various modifications are envisaged whereby the hoop holder can be adjusted to receive a range of different female hoop portion sizes without the need to change the hoop holder itself. Further, and as has been indicated above, the hoop holder may be quickly releasable from the support frame. However, alternatively it may be integrally molded to the support frame. Still further, accessories, such as clips to hold backing paper for the embroidered design may be provided.

In light of the numerous alterations, additions and modifications to the preferred embodiment noted above it will be understood that this invention is not in any way limited to the particular embodiment described or illustrated, but is intended to cover all embodiments which are within the scope of the appended claims.

I claim:

1. An apparatus for framing a portion of a fabric workpiece in an embroidery hoop, the apparatus comprising a hoop holder mount and a workpiece holder interconnected by way of a support frame, such that:

the hoop holder mount releasably mounts a hoop holder to the said apparatus, the hoop holder, when so mounted, being configured, positioned and arranged to be able to releasably locate a female portion of the embroidery hoop on the apparatus;

the support frame orients the workpiece holder and the hoop holder, when mounted to the apparatus, in a substantially common plane;

the workpiece holder is configured and arranged to be able to spread the fabric workpiece over the hoop holder when the hoop holder is mounted to the apparatus;

the apparatus being characterized by further comprising adjustment means, such that the hoop holder mount is fixed in position relative to the support frame, yet the position of the workpiece holder can be adjusted, using the adjustment means, to other positions in the substantially common plane.

2. An apparatus according to claim 1 wherein the adjustment means allows an almost infinite degree of adjustment to the position of the workpiece holder.

3. An apparatus according to claim 2 wherein the adjustment means comprises a first slide arrangement enabling crosswise adjustment, and a second slide arrangement enabling forward and backward adjustment.

4. An apparatus according to claim 3 wherein the workpiece holder includes a tubular frame shaped approximately to a said fabric workpiece.

5. An apparatus according to claim 4 wherein the tubular frame includes telescoping sections, and wherein the second slide arrangement comprises the telescoping sections of the tubular frame.

6. An apparatus according to claim 4 wherein the tubular frame is hingedly connected to the support frame by way of a crosswise extending member, which member is capable of limited rotational and lengthwise sliding actions thus comprising the first slide arrangement.

7. An apparatus according to claim 6 wherein the adjustment means further comprises a stop means to prevent pivoting of the tubular frame downwards out of the common plane, but allowing pivoting upwards out of the common plane.

8. An apparatus according to claim 7 wherein the stop means inhibits lengthwise sliding of the crosswise extending member when the tubular frame is in the common plane, but which allows lengthwise sliding when the tubular frame is pivoted up out of the common plane.

9. An apparatus according to claim 1 wherein the position of the workpiece holder is adjustable with a workpiece in position.

10. An apparatus according to claim 1 wherein the hoop holder mount includes a pair of crossed gauge lines visible when a hoop holder is mounted on the apparatus to indicate the center of the female portion of an embroidery hoop when in position, and wherein the gauge lines are therefore illuminated from beneath the hoop holder so as to be substantially visible through the workpiece positioned on the workpiece holder and overlying the hoop holder.

11. An apparatus according to claim 1 wherein the hoop holder is adjustable to receive and locate a range of different sized female hoop portions.

12. An apparatus for framing a portion of a fabric workpiece in an embroidery hoop, the apparatus comprising a hoop holder mount and a workpiece holder interconnected by way of a support frame such that:

the hoop holder mount releasably mounts a hoop holder to the apparatus, the hoop holder, when so mounted, being configured, positioned and arranged to be able to releasably locate a female portion of the embroidery hoop on the apparatus;

the support frame orients the workpiece holder and the hoop holder, when mounted to the apparatus, in a substantially common plane;

the workpiece holder is configured and arranged to be able to spread the fabric workpiece over the hoop holder when the hoop holder is mounted to the apparatus;

the apparatus being characterized in having adjustment means, such that the hoop holder mount is fixed in position relative to the support frame, yet the position of the workpiece holder is adjustable, using the adjustment means, to other positions in the substantially common plane, the apparatus being further characterized in having a hoop press to mount the workpiece between male and female portions of the embroidery hoop.

13. An apparatus according to claim 12 wherein the hoop press is mounted on the support frame, and comprises a compressing means moveable between a first, retracted, position and a second position where the male portion of the embroidery hoop is urged into frictional engagement with the female portion of the embroidery hoop with the workpiece mounted therebetween, and activating means for urging the compressing means between the first and second positions.

14. An apparatus according to claim 13 wherein the activating means is a hand operable lever.

15. An apparatus according to claim 13 wherein the hoop press includes limiting means to limit to a predetermined maximum level the urging force generated by the activating means on urging the compressing means between the first and second positions.

16. An apparatus according to claim 13 wherein the compressing means is pivotally mounted to the support frame, and pivots between the first and second positions.

17. An apparatus according to claim 16 wherein a said male hoop portion is retained on the compressing means while the said compressing means pivots from the first position to the second position.

18. An apparatus for framing a portion of a fabric work piece in an embroidery hoop, comprising:

a hoop holder;

a hoop holder mount for mounting the hoop holder to the apparatus, the hoop holder when so mounted, being configured, positioned and arranged to be able to releasably locate a female portion of the embroidery hoop of the apparatus;

a work piece holder configured and arranged to be able to spread the fabric work piece over the hoop holder when the hoop holder is mounted to the apparatus;

a support frame for interconnecting the hoop holder mount and the work piece holder, the support frame operative to orient the work piece holder and the hoop holder, when mounted to the apparatus, in a substantially common plane; and, adjustment means for maintaining the hoop holder mount in a fixed position relative to the support frame yet permitting the position of the work piece holder to be adjusted to other positions in the substantially common plane.

19. An apparatus as in claim 18, wherein the hoop holder is adapted to receive and locate the female portion of a keyed embroidery hoop, and wherein the hoop holder includes a pair of adjustably positionable lugs between which the key of the female portion of the embroidery hoop is snugly received.

* * * * *